US006060211A

United States Patent [19]

Sugitani

[11] Patent Number: 6,060,211

[45] Date of Patent: May 9, 2000

[54] IMAGE-FORMING MATERIAL AND ITS PREPARATION METHOD

[75] Inventor: Syouichi Sugitani, Hino, Japan

[73] Assignee: Konica Corporation, Japan

[21] Appl. No.: 08/969,787

[22] Filed: Nov. 13, 1997

[30] Foreign Application Priority Data

Nov. 18, 1996 [JP] Japan ..... 8-306399

[51] Int. Cl.[7] ..... G03C 1/805; G03C 1/72

[52] U.S. Cl. ..... 430/262; 430/263; 430/273.1; 430/270.1

[58] Field of Search ..... 430/273.1, 262, 430/263

[56] References Cited

U.S. PATENT DOCUMENTS

| | | | |
|---|---|---|---|
| 5,108,862 | 4/1992 | Kishimoto et al. | 430/108 |
| 5,256,509 | 10/1993 | Hayashi et al. | 430/66 |
| 5,691,103 | 11/1997 | Takeyama et al. | 430/273.1 |
| 5,856,060 | 4/1999 | Kawamura et al. | 430/273.1 |

FOREIGN PATENT DOCUMENTS

| | | | |
|---|---|---|---|
| 0160396 | 11/1985 | European Pat. Off. | B41M 5/26 |
| 0573092 | 12/1993 | European Pat. Off. | B41C 1/055 |
| 0582001 | 2/1994 | European Pat. Off. | B41M 5/38 |
| 360182445 | 9/1985 | Japan | G03G 5/08 |
| 61-061895 | 2/1986 | Japan | B41M 5/26 |
| 362011689 | 1/1987 | Japan | B41M 5/26 |
| 2176018 | 5/1985 | United Kingdom . | |
| 2176018 | 12/1986 | United Kingdom | B41M 5/26 |
| WO93/03928 | 3/1993 | WIPO | B41M 5/40 |

OTHER PUBLICATIONS

European Search Report EP 97 11 9941.

EPO—Patent Abstracts of Japan, Publication #61061895, Publication date: Mar. 29, 1986.

*Primary Examiner*—Mark F. Huff

*Assistant Examiner*—Yvette M Clarke

*Attorney, Agent, or Firm*—Jordan B. Bierman; Bierman, Muserlian and Lucas

[57] ABSTRACT

An image-forming material having an image-forming layer on a support a liquid comprising colorant particles and a binder and a protective layer on a support in this order is disclosed. The Vickers hardness H of the whole on an image forming side is from 50 to 500. An exposure is performed using a light having high intensity energy and an exposed area of said image-forming layer is then removed to form an image. The abrasion resistance of the image forming material is improved without deteriorating sensitivity and resolution.

23 Claims, No Drawings

IMAGE-FORMING MATERIAL AND ITS PREPARATION METHOD

BACKGROUND OF THE INVENTION

The present invention relates to an image-forming material and its preparation method, and more specifically to an image-forming material which exhibits high sensitivity and high resolution and is excellent in abrasion resistance of an image, and its preparation method.

Conventionally, recording methods have been known in which radiation energy such as laser radiation is converged and irradiated onto a recording material, and a part of the material is fuse deformed, scattered, burnt or vaporize removed. These methods exhibit advantages in that they are dry processes requiring no solution containing chemicals and high contrast is obtained because only the part subjected to exposure of radiation is fuse deformed, scattered and/or vaporize removed, and have been applied to photoresist materials, optical recording materials such as optical disk, etc., image-forming materials in which they themselves are employed to prepare visible images and the like.

For example, Japanese Patent Publication Open to Public Inspection Nos. 59-5447, 59-105638, 62-115153, etc. describe a method and its materials in which a binder resin is photo-dissociated by a pattern exposure to form a resist pattern; Japanese Patent Publication Open to Public Inspection Nos. 55-132536, 57-27788, 57-103137, etc. describe information recording in which an inorganic compound thin layer prepared by an evaporation method is exposed and is fuse deformed; further, Japanese Patent Publication Open to Public Inspection Nos. 64-56591, 1-99887, 6-40163, etc. describe materials employed for recording information by removing a colored binder using light-heat conversion, and U.S. Pat. No. 4,245,003 describes an image-forming material having an image-forming layer comprising graphite or carbon black and a peeling material.

When images are formed using the above-mentioned methods, image defects are sometimes caused on the surface of images due to the fact that abrasion marks are caused by friction between image-forming materials themselves, friction during handling and the like. In order to improve the abrasion resistance of images, Japanese Patent Publication Open to Public Inspection No. 60-255491 describes a technology in which an image-protecting layer is arranged on an image-recording layer. As the thickness of the image-protecting layer increases, the abrasion resistance of images is improved. However, on the other hand, disadvantages are caused in that energy necessary for image recording increases and further, resolution is degraded.

SUMMARY OF THE INVENTION

In view of the foregoing, the present invention has been accomplished. An object of the present invention is to provide the improvement in abrasion resistance of the whole of an image-forming material without causing the decrease in sensitivity and resolution.

The image forming material of the present invention and embodiment thereof are described.

The image-forming material comprises an image-forming layer comprising colorant particles and a binder and a protective layer on a support in this order wherein Vickers hardness H of the whole layers on a side having an image forming layer is from 50 to 500.

The image-forming layer is prefer ably prepared by coating a liquid comprising colorant particles and a binder.

The image is preferably formed by that an exposure is performed using a light having high intensity energy on the image forming layer and an exposed area of said image-forming layer is then removed.

In the image-forming material, Vickers hardness h of the image-forming layer is preferably from 50 to 200.

In the image-forming material, the image-forming layer is preferably hardened after coating and Vickers hardness $h_1$ before hardening is from 25 to 180 and Vickers hardness $h_2$ after hardening is from 50 to 200.

The total thickness of the whole layers on a side having an image forming layer is preferably from 0.1 to 10.0 $\mu$m.

Particles in the image-forming layer are those comprising a metallic atom.

The metallic atom-containing particles are preferably ferromagnetic metal powder.

In the image-forming material, $G'_2/G'_1$ of the whole layers on a side having an image forming layer is preferably 0.01 or more wherein $G'_1$ represents the storage elastic modulus at $10^{-4}$ of dynamic distortion caused by vibration having a constant frequency and $G'_2$ represents the storage elastic modulus at $10^{-2}$ of said distortion.

The image-forming layer has a thickness of preferably 0.1 to 5.0 $\mu$m.

Colorant particles in the image-forming layer are metallic atom-containing particles. The metallic atom-containing particles are preferably ferromagnetic metal powder.

The binder is preferably at least one selected from polyurethane, polyester, vinyl chloride resin, phenoxy resin and cellulose series resin.

The image forming material, wherein the image-forming material in which Vickers hardness H of an image-forming layer is from 50 to 200, may be prepared by a method that the image-forming layer is hardened after coating and Vickers hardness $h_1$ before coating is from 25 to 180 and Vickers hardness $h_2$ after coating is from 50 to 200 is prepared using at least one selected from calendering and thermosetting treatment after coating and drying the image-forming layer.

DETAILED DESCRIPTION OF THE INVENTION

The inventors have found that when the hardness and elastic modulus of the image-forming side of the image-forming material are in the range of definite values, image durability is improved and furthermore, when the hardness of the image-forming layer alone is adjusted in a certain range, high image durability is also obtained, and have accomplished the present invention. In the following, more explanation is given on those.

In the present invention, the hardness of all layers on the image-forming side on a support is evaluated in terms of the Vickers hardness and the adjustment of the Vickers hardness of 50 to 500 makes it possible to obtain high image durability. The Vickers hardness being not less than 50, the preferable image durability is obtained and the image is not erased by abrasion and the like. By controlling the Vickers hardness of 500 or more, the layer is suitable to make it possible to form an image because a part subjected to light having high intensity energy can be removed.

The Vickers hardness H, h, $h_1$ and $h_2$ are controlled by selecting the conditions such as species of raw material of image forming layer (for example, binder resin), species and amount of hardener, calendering condition (for example, pressure and temperature), application of thermosetting processing and its time, application of image protective layer, and so on. The suitable Vickers hardness is readily obtained for a person skilled in this art by selecting the above mentioned condition in combination optionally.

The Vickers hardness H, h, $h_1$ and $h_2$ are defined as values obtained as mentioned in the following.

Using a triangular pressure element having vertically opposite angle of 80°,

Load: 0.1 mg to 0.2 g

Indenting speed: 1 to 25 nm/second

Measurement ambient: 20 to 30° C./40 to 80% relative humidity

Indentation depth: 3 μm or less from the surface

Under the above conditions, a diamond trigonal pyramid needle is indented using a piezo-electric actuator. At this time, letting X be the indentation depth indented by the load W, hardness H(a) at a depth of a is expressed as;

$$W(X)=K\int H(a)\ (X-a)da(K\text{: constant})$$

For a uniform material having variation in hardness, $$W(X)=1/2KHX^2$$

Accordingly, the relationship of the load W(X) versus the square of the indentation depth X results in straight line and H (Vickers hardness) can be obtained according to the slope.

Furthermore the image-forming material which is excellent in abrasion resistance is obtained in such a way that the Vickers hardness h of the image-forming layer is from 50 to 200, and in addition, the image-forming layer is hardened after coating; the Vickers hardness $h_1$ prior to hardening is from 25 to 180 and the Vickers hardness after hardening is from 50 to 200. By rendering the Vickers hardness of the image-forming layer h 50 to 200, the image durability can be enhanced. Furthermore, the formation of coating defects such as abrasion marks and the like caused in production processes can be prevented. In addition, by rendering the Vickers hardness $h_1$ before coating 25 to 180, the formation of coating defects such as abrasion marks and the like caused in the production process before hardening can be prevented.

In the present invention, with the use of hardening agents, the hardness of the image-forming layer can be controlled. As the hardening agents, can be employed, without any limitation, those which can harden the image-forming layer. Examples such as those hardening agents include polyisocyanates, etc. which are employed to synthesize polyurethane in a binder resin described in the following. By hardening the image-forming layer to which any of hardening agents such as those is added, not only the durability of the formed image can be enhanced but also background tints on an exposed part after removal can be eliminated.

Furthermore, by arranging an image-protecting layer composed of a binder as the main component, the hardness of the whole layers arranged on a support can be adjusted to a desired value to yield the high image durability.

Furthermore, by optimizing the storage elastic modulus under a certain stress subjected to the image-forming layer, durability can result in the image-forming layer. Namely, the inventors, based on the study mentioned below, have evaluated the dynamic viscoelasticity of the image-forming layer as a parameter of the storage elastic modulus under a certain distortion force and have enhanced the durability of the image-forming material by optimizing the storage elastic modulus.

One of dynamic qualities of the image-forming layer includes durability against a large and small deformation distortion caused during handling a image-forming material. The degradation of the durability of the image-forming material itself is estimated due to the fact that an internal structure order formed in the image-forming layer is destroyed by the distortion caused in the transporting line in the system at the image forming. This image-forming layer incorporates colorant particles and a high polymer binder, and it is estimated that the dynamic quality largely depends on both qualities. Furthermore, it is found that there is a close relationship between the dynamic quality and a dispersibility of the colorant particles in a binder. For example, it is supposed that an internal structure having a large difference between the elastic modulus under small deformation distortion and that under large deformation distortion corresponds to a structure in which the dispersibility of the colorant in a binder in the image-forming layer is low and the interior of the image-forming layer is not homogeneous and the number of strain concentration points increases and structure destruction is likely caused. On the other hand, it is supposed that the internal structure having a small difference between the elastic modulus under small deformation distortion and that under large deformation distortion is excellent in the dispersibility and the interior of the image-forming layer corresponds to a homogeneous structure and is not destroyed under high distortion. Accordingly it may be noted that the colorant is well dispersed in a binder and the durability of the image-forming layer is improved.

The storage elastic modulus of the coated layer is obtained by subtracting the storage elastic modulus of the support from that of the coated layer and the support as a whole. The storage elastic modulus G' is defined herein as a measurement obtained as follows. As a measurement apparatus, for example, RSA-II (manufactured by Leo Metrics Co.) is employed and using a sample having a length and width of 23 mm and 2 mm, respectively, which is prepared by coating an image-forming layer on a polyethylene terephthalate film, the measurement is obtained by changing applied distortion in the range of $2\times10^{-5}$ to $2\times10^{-2}$ at a frequency of 100 rad/second at temperatures of 0 to 40° C.

In the present invention, the storage elastic modulus is obtained as described above and the ratio of $G'_2/G'_1$ of the whole layers on a side having an image forming layer is adjusted to 0.01 ore more, wherein $G'_1$ is the storage elastic modulus at $10^{-4}$ of dynamic distortion (applied distortion) and $G'_2$ is the storage elastic modulus at $10^{-2}$ of the dynamic distortion (applied distortion), and particularly preferably 0.03 or more and 1.0 or less. According to combinations of employed colorant particles and binders or deposition of dispersion methods, durability against desired deformation distortion can be evaluated using the storage elastic modulus.

The storage elastic modulus is controlled by selecting the conditions such as species of raw material of image forming layer (for example, binder resin), species and amount of hardener, calendering condition (for example, pressure and temperature), application of thermosetting processing and its time, application of image protective layer, and so on. The suitable storage elastic modulus is readily obtained for a person skilled in this art by selecting the above mentioned condition in combination optionally.

In the following, structures of the image-forming material are explained in detail.

(Image-forming Material)

The image-forming material, as the basic structure, is composed of a support having thereon an image-forming layer and a protective layer if desired.

(Support)

A support employed in the present invention includes, for example, each of plastic films composed of acrylic acid esters, methacrylic acid esters, polyethylene terephthalate, polybutylene terephthalate, polyethylene naphthalate, polycarbonate, polyacrylate, polyvinyl chloride, polyethylene, polypropylene, polystyrene, nylon, aromatic polyamide, polyether ether ketone, polysulfone, polyethersulfone, polyimide, polyetherimide, etc. and furthermore, plastic film having layers of 2 or more comprising resins mentioned above. In order to obtain an image having high resolution, the surface roughness Ra, measured using the JIS B 0601, of the surface of the support which contacts with an image-forming layer is preferably less than 0.10 $\mu$m and more preferably less than 0.05 $\mu$m. With the use of the support as mentioned above, images having high resolution can be obtained. Furthermore, remaining ratio of the part of the image-forming layer where bonding strength is decreased by an exposure of light having high intensity energy and the exposed part is removed can be reduced to obtain an image excellent in contrast.

Furthermore, as the support, one which is stretched in the form of film and thermally set is preferable in terms of dimensional stability and furthermore, which has high transmittance at the wavelength of an exposure light having high intensity energy is preferable and the transmittance is preferably 50% or more and more preferably 70% or more. In addition, in view of the transport and abrasion resistance at the production of the image-forming material, fillers such as titanium oxide, zinc oxide, barium sulfate, calcium carbonate, etc., coloring agents such as bluing agent, antistatic agents and the like may be added. The thickness of a support is from about 10 to about 500 $\mu$m and preferably from 25 to 250 $\mu$m.

(Image-forming Layer)

The image-forming layer of the image-forming material comprises at least colorant particles and a binder.

Any colorant particles can be employed with no limitation if they enable the decrease in the bonding strength between the image-forming layer and the support. In order to conduct efficiently image formation, colorants which absorb the light having high intensity energy employed for an imagewise exposure are preferable and particularly, colorants having absorption in the range of 350 to 850 nm are preferable so as to read an image.

Colorants such as those mentioned above include metal-containing dyes such as metal phthalocyanines, metal porphyrin, etc. and metal atom-containing particles such as metal powder particles; metal oxide powder particles such as cobalt oxide, iron oxide, chromium oxide, copper oxide, titanium black, etc.; nitride-containing powder such as niobium nitride; metal carbide powder such as tantalum carbide, metal sulfide powder. Of these, in obtaining a high resolution image securing high intensity, inorganic metal particles in which particle size and shape are comparatively uniform are preferable. Examples include metal particles composed of only metals of one or two or more kinds, oxides, nitride or carbide particles of these metals, various magnetic powder particles employed in magnetic ink, etc.

In case the ferromagnetic particles are used in the invention ferromagnetic iron oxide powder, ferromagnetic metal powder, or cubic tabular powder is optionally used and among these ferromagnetic iron oxide powder or ferromagnetic metal powder is suitably used and especially ferromagnetic metal powder is more suitably used.

The ferromagnetic iron oxide includes $\gamma$-$Fe_2O_3$, $Fe_3O_4$, and an intermediate iron oxide thereof, $Fe_xO$ ($1.33<x<1.50$).

Examples of the ferromagnetic metal powder include ferromagnetic metal powders such as Fe type, Co type, Fe—Al type, Fe—Al—Ni type, Fe—Al—Zn type, Fe—Al—Co type, Fe—Al—Ca type, Fe—Ni type, Fe—Ni—Al type, Fe—Ni—Co type, Fe—Ni—Zn type, Fe—Ni—Mn type, Fe—Ni—Si type, Fe—Ni—Si—Al—Mn type, Fe—Ni—Si—Al—Zn type, Fe—Ni—Si—Al—Co type, Fe—Al—Si type, Fe—Co—Ni—P type, Fe—Co—Al—Ca, Ni—Co type, and magnetic metal powder whose principal components are Fe, Ni and Co. Of them, Fe type metal powders are preferable, and include Co-containing iron oxides such as Co-containing $\gamma$-$Fe_2O_3$, Co-coated $\gamma$-$Fe_2O_3$, Co-containing $\gamma$-$Fe_3O_4$, Co-coated $\gamma$-$Fe_3O_4$, and Co-containing magnetic $FeO_x$ ($4/3<x<3/2$). In view of corrosion-resistance and dispersibility the preferred are Fe—Al type ferromagnetic metal powders including Fe—Al type, Fe—Al—Ca type, Fe—Al—Ni type, Fe—Al—Zn type, Fe—Al—Co type, Fe—Ni—Si—Al—Co type and Fe—Co—Al—Ca type. Of these powders, the preferable are ferromagnetic powder in which the content ratio of a Fe atom to an Al atom is 100:1 to 100:20 and the content ratio at 100 Å depth of a Fe atom to an Al atom is 30:70 to 70:30 measured through ESCA (X ray spectroscopy for chemical analysis) or ferromagnetic powder containing at least one of Fe, Ni, Al, Si, Co and Ca in which the Fe content is 90 atom % or more, the Ni content is 1 to 10 atom %, the Al content is 0.1 to 5 atom %, the Si content is 0.1 to 5 atom %, the Co or Ca content (or the sum content of Co and Ca) is 0.1 to 13 atom %, and the content ratio by the number of atom at 100 Å depth, Fe:Ni:Al:Si:(Co and/or Ca) is 100:(not more than 4):(10 to 60):(10 to 70):(20 to 80), measured through ESCA (X ray spectroscopy for chemical analysis).

The shape of the ferromagnetic powder is needle-like, having an average major axial length of less than 0.30 $\mu$m and preferably less than 0.20 $\mu$m. Employing such a powder, the surface property of the image forming layer is improved.

The metal containing particle content of the image forming layer is 50 to 99 weight %, and preferably 60 to 95 weight %.

The binder resin can be used without limitations, as long as the binder can carry metal containing particles and a colorant absorbing a light of a light source. Typical binders are polyurethanes, polyesters, and vinyl chloride type resins such as vinyl chloride copolymers. Preferably, these resins contain repeated units having at least one polar group selected from —$SO_3M$, —$OSO_3M$, —COOM and —PO $(OM_1)_2$, wherein M represents a hydrogen atom or an alkali metal atom, $M_1$ represents a hydrogen atom, an alkali metal atom or an alkyl group. These polar groups have a function to enhance dispersibility of magnetic particles and are contained in the resin at a rate ranging from 0.1 to 8.0 mol %, preferably from 0.5 to 6.0 mol %.

The binders can be used either singly or in combination of two or more kinds.

The polar group-containing polyvinyl chloride is prepared by reaction of a hydroxy group containing resin such as vinyl chloride-vinyl alcohol copolymer with a polar group and chlorine atom containing compound such as $ClCH_2CH_2SO_3M$, $ClCH_2CH_2OSO_3M$, $ClCH_2COOM$ or $ClCH_2P$ (=O) $(OM_1)_2$.

Further, in order to improve thermal stability of a binder, an epoxy group is preferably incorporated in a vinyl chloride copolymer. The content of a unit having an epoxy group in the copolymer is 1 to 30 mol %, preferably 1 to 20 mol %. The monomer to incorporate epoxy is preferably glycidyl acrylate.

The polar group-containing polyester is prepared by condensation reaction of a polyol with a polybasic acid having a polar group. The polybasic acid having a polar group includes 5-sulfoisophthalic acid, 2-sulfoisophthalic acid, 4-sulfoisophthalic acid, 3-sulfophthalic acid, 5-sulfoisophthalic acid dialkyl, 2-sulfoisophthalic acid dialkyl, 4-sulfoisophthalic acid dialkyl and 3-sulfophthalic acid dialkyl, or a metal salt thereof, and the polyol includes trimethylolpropane, hexane triol, glycerin, trimethylolethane, neopentyl glycol, pentaerythritol, ethylene glycol, propylene glycol, 1,3-butane diol, 1,4-butane diol, 1,6-hexane diol, diethylene glycol and cyclohexane dimethanol.

The polar group-containing polyurethane is prepared by reaction of a polyol with a polyisocyanate. The polyol includes polyol polyester prepared by reaction of polyol with a polybasic acid having a polar group. The polyisocyanate includes diphenylmethane-4,4'-diisocyanate, 2,4-tolylene diisocyanate, 2,6-tolylene diisocyanate, 1,5-naphthalene diisocyanate and lydin isocyanate methylester. Another preparation method of the polar group-containing polyurethane includes a reaction of polyurethane having a hydroxy group with a compound containing a polarsuch a and a chlorine atom such as $ClCH_2CH_2SO_3M$, $ClCH_2CH_2OSO_3M$, $ClCH_2COOM$ or $ClCH_2P(=O)(OM_1)_2$.

Besides the above resins, the binder resin includes vinyl chloride resins such as polyolefins such as butadiene-acrylonitrile copolymers, polyvinyl acetals such as polyvinyl butyrals, cellulose derivatives including nitrocellulose, styrene resins such as styrene-butadiene copolymers, acryl resins such as polymethylmethacrylates, polyamide resins, phenolic resins, epoxy resins, and phenoxy resins.

The above mentioned polyurethan, polyester, vinyl chloride resin, phenoxy resin or cellurose resin is preferably applied for good dispersing coloring particles in image forming layer and adjusting storage modulus of elasticity.

Other additive

The image forming layer may contain additives such as durability improvers, dispersing agents, anti-static agents, fillers and hardeners, as long as the effects of the invention are not inhibited.

Fatty acid, fatty acid ester, fatty acid amide, (modified) silicon oil, fluoride resin, carbon fluoride etc are referred as a lubricant. Polyisocyanate and so on are cited as a durability improver. The dispersing agents include fatty acids having 12 to 18 carbon atoms such as lauric acid and stearic acid or their amides, alkali metal salts or alkali earth metal salts, polyalkyleneoxide alkyl phosphates, lecithin, trialkyl polyolefinoxy quaternary ammonium salts and azo compounds having a carboxy group or a sulfon group. The antistatic agents include a cationic surfactant, an anionic surfactant, a nonionic surfactant, a polymeric antistatic agent and conductive fine particles and compounds described on pages 875 and 876, 11290 Chemicals, edited by Kagaku Kogyo Nippo Co. Ltd.

The fillers include inorganic fillers such as carbon black, graphite, $TiO_2$, $BaSO_4$, ZnS, $MgCO_3$, $CaCO_3$, ZnO, CaO, $WS_2$, $MOS_2$, MgO, $SnO_2$, $Al_2O_3$, $\alpha$-$Fe_2O_3$, $\alpha$-FeOOH, SiC, $CeO_2$, BN, SiN, MoC, BC, WC, titanium carbide, corundum, artificial diamond, garnet, tripoli, diatomaceous earth, dolomite, and organic fillers such as polyethylene resin particles, fluorine-containing resin particles, guanamine resin particles, acryl resin particles, silicone resin particles, and melamine resin particles. These fillers can be used as a releasing agent. The addition amount of the inorganic or organic fillers is preferably 0.1 to 70 weight %, although the amount varies depending on their specific gravity.

The addition amount of the additives in the image forming layer is 0–20 weight %, and preferably 0–15 weight %.

The thickness of the image forming layer is 0.05 to 5.0 $\mu$m, and preferably 0.1 to 3.0 $\mu$m. The thickness of the image forming layer is over 0.05 $\mu$m, and preferably 0.1 $\mu$m or more and not more than 5.0 $\mu$m. The image forming layer may be a single layer or multiple layers whose compositions may be the same or different. In the multiple layers, the layer closest to a support preferably contains a colorant capable of absorbing light of a light source in a larger amount. The layer farther from a support may contain a colorant capable of absorbing a light having a wavelength longer than the light of a light source.

Image protective layer

The thickness of the image protective layer is 0.03–5.0 $\mu$m, and preferably 0.05–0.5 $\mu$m.

The image protective layer is preferably composed of resin binder and fine particle mainly.

The resin for the binder can be used without any limitation, as long as it can carry the fine particles. The binder resin includes polyurethane, polyester, vinyl chloride resins such as vinyl chloride copolymers and vinyl chloride-vinyl acetate copolymers, polyolefins such as butadieneacrylonitrile copolymers, polyvinyl acetals such as polyvinyl butyrals, cellulose derivatives including nitrocellulose, styrene resins such as styrene-butadiene copolymers, acryl resins such as polymethyl methacrylates, polyamide resins, phenolic resins, epoxy resins, phenoxy resins, acetal resin such as polybutyl butyral, polyvinyl acetoacetal, and polyvinylformal, and water soluble resins such as polyvinyl alcohol and gelatin. The resin binders can be used singly or in combination.

The binders can be used either singly or in combination of two or more kinds. The content of binder in the image protective layer is 10–99.5 wt %, and preferably 40–98 wt % of components of the image protective layer.

The image protective layer preferably contains a hardener such as a polyisocyanate in order to enhance its durability. When the image protective layer is hardened, the binder resin of the image protective layer has a functional group capable of reacting with a hardener and cross-linking. For example, when the hardener is an isocyanate compound, a phenoxy, cellulose, polyvinyl acetal, acryl or urethane resin, a polyvinyl chloride resin or a polyester resin is preferably used.

Examples of the fine particle include same material as those for filler, and preferably it is added 0.1–70 wt % according to its gravity. The fine particles are preferably those having narrow particle size distribution and uniform particle size. Actual examples include silicon resin fine particle (trade name Tospearl product of Toshiba Silicon Co,. Ltd), cross linked acryl fine particle MR series, cross linked polystyrene fine particle SGP series, acryl ultra fine particle series MP and so on (product of Sokenkagaku Co,. Ltd.).

The invention is effected by an image protective layer in which some fine particles protrude from the surface. Accordingly, an average particle size r of the fine particles greater than the thickness r of the image protective layer is advantageous, since most particles protrude from the surface of the image protective layer. Therefore, the average particle size r of the fine particles in the invention is preferably 0.3 to 20 $\mu$m, and more preferably 0.3 to 4.5 $\mu$m. The content of the fine particles in the image protective layer in the invention is 2 to 150 mg/m$^2$, and preferably 2 to 100 mg/m$^2$. In the invention, when the fine particles have a polymerizable functional group on the surface, image durability is greatly improved since adhesion between the image forming layer and the fine particles is enhanced during hardening. The example of the fine particles includes FX-GSZ-07 produced by NIPPON SHOKUBAI Co., Ltd.

In the present invention it is preferable for adjusting the hardenss and storage modulus of elasticity to make a thickness of all layers of 0.1–10 $\mu$m.

Preparation Method of Image Forming Layer

The image forming layer is formed by kneading ferromagnetic particles, a binder, and optionally a lubricant, a durability improving agent, a dispersant, an anti-static agent, a filler and a hardener in a solvent to obtain a coating composition, coating the coating composition on the support and drying.

The solvents include alcohols (ethanol, propanol), cellosolves (methyl cellosolve, ethyl cellosolve), aromatic solvents (toluene, xylene, chlorobenzene), ketones (acetone, methylethyl ketone), esters (ethylacetate, butylacetate), ethers (tetrahydrofurane, dioxane), halogenated solvents (chloroform, dichlorobenzene), amide type solvents (dimethylformamide, N-methylpyrrolidone). As for the kneaders for an image forming layer composition, suitable examples include two-roll mills, three-roll mills, ball mills, pebble mills, coball mills, Tron mills, sand mills, sand grinders, Sqegvari attritor, high-speed impeller dispersers, high-speed stone mills, high-speed impact mills, dispersers, high-speed mixers, homogenizers, supersonic dispersers, open kneaders, and continuous kneaders.

In order to form an image forming layer on a support, coating is carried out by, for example, an extrusion method and then it is dried. Magnetic particles are optionally oriented may be carried out.

Calender treatment is preferably carried out in order to make hard the surface of the image forming layer. The calender treatment is, for example, carried out in such way that the support having dried image forming layer is introduced to calendering machine, and calender treatment is carried out. As for calender condition, temperature is preferably 60 to 120° C., more preferably 70 to 110° C. Pressure is preferably line pressure of 100 to 500 Kg/cm, more preferably 200 to 400 Kg/cm. When each of the temperature and pressure is lower than the lower limit, the coated layer is not satisfactory and resolution of the image is lowered. When these are higher than the higher limit, coating layer is cracked and the product is not acceptable.

When the another layer than the image forming layer is provided, each layer may be coated and dried separately, and the layers may be multilayer coated by wet-on wet coating method. In carrying out wet-on-wet multilayer coating, a combination of an extrusion coater with a reverse roll, a gravure roll, an air doctor coater, a blade coater, an air knife coater, a squeeze coater, a dip coater, a bar coater, a transfer roll coater, a kiss coater, a cast coater or a spray coater can be used. The adhesion between upper and lower layers is enhanced, since in the multilayer coating according to the wet-on-wet method the upper layer is coated on the wet lower layer.

The heat curing process may be applied in order to harden the coated layer in place of or in addition to calender treatment. Temperature is 40 to 80° C. and more preferably 50 to 70° C. for the heat curing condition. Curing time is preferably, in case of single layer, 12 to 36 hours and more preferably 18 to 30 hours.

<Image Forming Method>

The image forming material is subjected to imagewise exposing by a high density energy light, and then the exposed portion of image forming layer is removed whereby an image is formed. The image exposure may be conducted from the support side or image forming layer. The high density energy light for image exposure is not limitative as far as it make possible by exposure to make the image forming layer removed by any means. In order to obtain a high resolving power, the light source is preferably an electromagnetic wave capable of making the energy spots smaller, particularly, a UV light having 1 nm to 1 mm wavelength, a visible light or an infrared light. Such a high density energy light includes, for example, a laser light, an emission diode, a xenon flush lamp, a halogen lamp, a carbon arc light, a metal halide lamp, a tungsten lamp, a quarts mercury lamp and a high pressure mercury lamp. The energy applied is optionally adjusted by selecting an exposure distance, an exposure time or an exposure strength according to kinds of image forming materials used.

When an entire exposure is carried out using the high density energy light, the exposure is carried out through a mask material having a negative pattern made of a light shielding material.

When an array light such as an emission diode array is used or exposure using a halogen lamp, a metal halide lamp or a tungsten lamp is controlled using an optical shutter material such as liquid crystal or PLZT, a digital exposure according to an image signal is possible, and direct writing is possible without using the mask material.

However, this method requires additional optical shutter beside the light source. Therefore, the digital exposure is preferably carried out using a laser light.

When the laser light is used, the light can be condensed in the beam form and a latent image is formed using a scanning exposure according to an image. The laser light is easy to condense the exposure spots in small size and therefore, a highly dissolved image can be obtained. The laser light used in the invention is well known. The laser source includes solid lasers such as a ruby laser, a YAG laser, a glass laser, a gas laser such as a He—Ne laser, a Ar laser, a Kr laser, a $Co_2$ laser, a Co laser, a He—Cd laser, a $N_2$ laser, an eximer laser, an semiconductor laser such as a InGaP laser, a AlGaAs laser, a GaAsP laser, a InGaAs laser, a InAsP laser, $CdSnP_2$ laser or a GaSb laser, a chemical laser, and a dye laser. Of these laser light sources, a laser having a 600 to 1200 nm wavelength is preferable in sensitivity in order to produce effectively abrasion, since a light energy can be effectively converted to a heat energy. Among these a laser having a 600 to 1200 nm wavelength is preferable in sensitivity in order to produce effectively abrasion, since a light energy can be effectively converted to a heat energy, further, high luminescent laser having a single wavelength light.

The image forming method comprises the steps of imagewise exposing the image forming layer of the image forming material to a high density energy light, whereby adhesion force at the exposed portions between the support and the image forming layer is reduced, and then removing the image forming layer at exposed portions where the adhesion force is reduced. The reduction of the adhesion force includes the phenomena that the image forming layer is completely scattered by physical or chemical change, the image forming layer is partly destroyed and/or scattered, and physical or chemical change occurs only neighbor of the support without destroying surface of image forming layer.

EXAMPLES

Hereafter the invention illustrated in view of Examples. Hereafter, "part" means the "part by weight of effective component" without special note.

Example 1

(Preparation of Image-forming Material)

Corona discharging was applied to the surface of polyethylene terephthalate film support on which an image-forming layer was arranged and on the reverse surface was arranged a backing layer by coating a mixture composed of an organic solvent, a polyester resin, a silicone resin filler and an antistatic agent. An image-forming layer as mentioned below was arranged on the resulting support.

(Image-forming Layer-1)

Fe—Si—Al—Ni—Co series ferromagnetic metal powder 100 parts (Fe : Si : Al : Ni : Co ratio of the number of atoms=100 : 1 : 4 : 3 : 5 (total), average major axial diameter: 0.14 $\mu$m, $H_c$: 1760 oersted, $\sigma_s$: 120 emu/g, BET: 59 $m^2/g$)

Vinyl chloride series resin containing potassium sulfonate group 6 parts (MR-110 manufactured by Nippon Zeon Co., Ltd.)

Polyurethane resin containing sodium sulfonate group 6 parts (UR-8300 manufactured by Toyoboseki Co., Ltd.)

Stearic acid 1 part

Myristic acid 1 part

Butyl stearate 1 part

Polyisocyanate compound 5 parts (Coronate L manufactured by Nippon Polyurethane Co., Ltd.)

Cyclohexanone 100 parts

Methyl ethyl ketone 100 parts ps Toluene 100 parts

A composition composed of above materials was knead dispersed using a sand mill and an image-forming layer coating dispersion was prepared. The resulting dispersion was coated on a support using extrusion coating and dried. Calendering was performed under a pressure of 150 kg/cm at 90° C. and an Image-forming Layer-1 having a thickness of 1.0 $\mu$m was formed.

(Image-forming Layer-2)

An Image-forming Layer-2 having a thickness of 1.5 $\mu$m was prepared in the same way as in the Image-forming Layer-1 except that the same amount of a phenoxy resin (PKHH manufactured by UCC Co.) was employed instead of MR-110 (potassium sulfonate group containing vinyl chloride series resin) manufactured by Nippon Zeon Co., Ltd.

(Image-forming Layer-3)

An Image-forming Layer-3 was prepared in the same manner as in the Image-forming Layer-i except that Co doped $FeO_x$ (average major axial diameter=0.45 $\mu$Am, $H_c$=750 oersted, BET=45 $m^2/g$, x=1.427) was used instead of Fe—Al series ferromagnetic metal powder.

(Image-forming Layer-4)

Carbon black (average particle diameter=0.04 $\mu$m) 25 parts Potassium sulfonate group containing vinyl chloride Series resin (same as above-mentioned) 13 parts Sodium sulfonate group containing polyurethane 13 parts resin (UR-8700 manufactured Toyoboseki Co. Ltd.)

$\alpha$-Alumina 8 parts

Stearic acid 1 part

Butyl stearate 1 part

Polyisocyanate compound (same as above-mentioned) 5 parts

Cyclohexanone 80 parts

Methyl ethyl ketone 80 parts

Toluene 80 parts

The Image-forming Layer-4 having a thickness of 2.0 $\mu$m was prepared in the same manner as in the Image-forming Layer-1 except that the composition mentioned above was used.

Subsequently, the following composition 1) or 2) was coated on the image-forming layer at a coating amount of 0.1 $g/m^2$ using wire bar coating. Thus, the Image-protecting Layer-1 or Image-protecting Layer-2 was formed.

Composition 1)

Binder resin: Phenoxy resin 3.5 parts (UCAR phenoxy resin PKHH manufactured by Union Carbide Co.)

Hardening agent: diphenylmethane-4,4'-diisocyanate 1.5 parts (Millionate MT manufactured by Nippon Polyurethane Co., Ltd.)

Methyl ethyl ketone 95 parts

Fine particle: silicone resin fine particle (average particle diameter 2.0 $\mu$m) 0 or 40 $mg/m^2$ (Tospearl 120 manufactured by Toshiba Silicone Co., Ltd.)

Composition 2)

The same as the Composition 1) except that potassium sulfonate group containing vinyl chloride series resin (MR-110 manufactured by Nippon Zeon Co., Ltd.) was used as a binder resin instead of the phenoxy resin.

As a peeling layer, a transparent polyethylene terephthalate film (S100 manufactured by Diafoil Hoechst Co., Ltd.) was employed and on the peeling layer, an adhesive layer forming coating composition mentioned below was coated and dried to form an adhesive layer having a thickness of 4.0 $\mu$m. Thereafter, the adhesive layer surface of the peeling layer was faced with the protective layer surface and underwent pressure treatment using pressure rolls (transporting speed: 30 mm/second, pressure: 2.0 kg/cm) so that no air bubble is included. Thus, an image-forming material was prepared in which the image-forming layer, protective layer and peeling layer were coated in this order.

Ethylene-vinyl chloride copolymer 3.0 parts (Everflex V410 manufactured by Mitsui du Pont Polychemical Co., Ltd.)

Silicon fine particle 0.6 part (Tospearl 145 manufactured by Toshiba Silicone Co., Ltd.)

Toluene 90 parts

Cyclohexanone 6.4 parts

Table 1 shows prepared image-forming materials and Vickers hardness.

TABLE 1

| Sample No. | Image-forming Layer | Protective Layer | Calendering | Vickers Hardness |
|---|---|---|---|---|
| 1 | 1 | 1 | No | 324 |
| 2 | 1 | 1 | Yes | 478 |
| 3 | 1 | 2 | No | 286 |
| 4 | 1 | 2 | Yes | 421 |
| 5 | 1 | None | No | 82 |
| 6 | 1 | None | Yes | 189 |
| 7 | 2 | 1 | No | 336 |
| 8 | 2 | 1 | Yes | 496 |
| 9 | 2 | 2 | No | 301 |
| 10 | 2 | 2 | Yes | 444 |
| 11 | 2 | None | No | 86 |
| 12 | 2 | None | Yes | 192 |
| 13 | 3 | 1 | No | 275 |
| 14 | 3 | 1 | Yes | 421 |
| 15 | 3 | 2 | No | 265 |
| 16 | 3 | 2 | Yes | 400 |
| 17 | 3 | None | No | 53 |
| 18 | 3 | None | Yes | 152 |
| Comparative 1 | 4 | 1 | No | 36 |
| Comparative 2 | 4 | 1 | Yes | 44 |
| Comparative 3 | 4 | 2 | No | 42 |
| Comparative 4 | 4 | 2 | Yes | 48 |
| Comparative 5 | 4 | None | No | 18 |
| Comparative 6 | 4 | None | Yes | 10 |

(Image-forming Method)

Using a semiconductor laser LT090MD (main wavelength 830 nm) manufactured by Sharp Corporation, an imagewise exposure was performed using a scanning exposure from the support side while focused on the interface between the support and the image-forming layer. Thereafter, the peeling layer was peeled (peeling angle 189°, peeling speed 30 mm/second) and an image was formed by transferring, to the peeling layer side, the part where the bonding strength was reduced.

(Evaluation)

Sensitivity, and resolution and abrasion resistance of formed images were evaluated according to the following scales.

Sensitivity

A solid scanning exposure was performed using a beam diameter of 4 μm so that an image having a size of 0.5 mm×0.5 mm was formed and the scale consisting of five levels was used to evaluate the average exposure amount (E: unit $mJ/cm^2$) on the surface of the image-forming material on which the image was formed.

5 . . . E≦100

4 . . . 100<E≦250

3 . . . 250<E≦400

2 . . . 400<E≦600

1 . . . 600<E

Resolution

An image was formed with an average exposure amount on the surface of the image-forming material using a scanning exposure having a beam diameter of 4 μm and a scanning pitch of 4 μm, and evaluation was performed using the scale consisting of four levels according to the number (N) of resolvable lines per 1 mm regarding to the obtained image.

4 . . . 125≦N

3 . . . 120≦N<125

2 . . . 110≦N<120

1 . . . N<110

Abrasion Resistance

Tests were performed using a scratch meter. Load of 0 to 200 g was applied using a needle of a diameter of 0.1 mm onto the image-protecting layer of each sample on which a peeling layer was not put yet. Thereafter, the state of each sample surface was visually observed.

4 . . . No change is observed.

3 . . . Change in gloss is observed. However, no abrasion reaches to the image-forming layer.

2 . . . A portion of the image-forming layer is damaged and transmission intensity at the portion decreases.

1 . . . The support of the image-forming layer is damaged.

Table 2 shows above results.

TABLE 2

| Sample No. | Sensitivity | Resolution | Abrasion Resistance |
|---|---|---|---|
| 1 | 4 | 4 | 3 |
| 2 | 5 | 4 | 4 |
| 3 | 4 | 4 | 3 |
| 4 | 5 | 4 | 4 |
| 5 | 5 | 4 | 3 |
| 6 | 5 | 4 | 3 |
| 7 | 4 | 4 | 4 |
| 8 | 5 | 4 | 4 |
| 9 | 4 | 4 | 4 |
| 10 | 5 | 4 | 4 |
| 11 | 5 | 4 | 3 |
| 12 | 5 | 4 | 3 |
| 13 | 4 | 3 | 4 |
| 14 | 5 | 4 | 4 |

TABLE 2-continued

| Sample No. | Sensitivity | Resolution | Abrasion Resistance |
|---|---|---|---|
| 15 | 4 | 3 | 4 |
| 16 | 4 | 4 | 4 |
| 17 | 3 | 4 | 3 |
| 18 | 3 | 4 | 3 |
| Comparative 1 | 1 | 2 | 2 |
| Comparative 2 | 2 | 1 | 2 |
| Comparative 3 | 1 | 1 | 2 |
| Comparative 4 | 2 | 1 | 2 |
| Comparative 5 | 1 | 1 | 1 |
| Comparative 6 | 1 | 2 | 1 |

EXAMPLE 2

An image-forming material was prepared in the same manner as in example 1 except that when preparing an image-forming layer coating composition, mix kneading conditions were varied, and was evaluated. Table 3 shows the storage elastic modulus ratio of image-forming materials to the image-forming layer and Table 4 shows results.

TABLE 3

| Sample No. | Image-forming Layer | Calendering | Kneading Apparatus | G'2/G'1 |
|---|---|---|---|---|
| 19 | 1 | Yes | Pressure Kneader | 0.65 |
| 20 | 1 | Yes | Henschel Mixer | 0.45 |
| 21 | 1 | Yes | Dissolver | 0.15 |
| 22 | 1 | No | Pressure Kneader | 0.23 |
| 23 | 1 | No | Henschel Mixer | 0.18 |
| 24 | 2 | Yes | Pressure Kneader | 0.68 |
| 25 | 2 | Yes | Henschel Mixer | 0.32 |
| 26 | 2 | Yes | Dissolver | 0.06 |
| 27 | 2 | No | Pressure Kneader | 0.21 |
| 28 | 2 | No | Henschel Mixer | 0.16 |
| 29 | 3 | Yes | Pressure Kneader | 0.12 |
| 30 | 3 | Yes | Henschel Mixer | 0.08 |
| 31 | 3 | Yes | Dissolver | 0.01 |
| 32 | 3 | No | Pressure Kneader | 0.05 |
| 33 | 3 | No | Henschel Mixer | 0.03 |
| Comparative 7 | 1 | No | Dissolver | 0.0008 |
| Comparative 8 | 2 | No | Dissolver | 0.001 |
| Comparative 9 | 3 | No | Dissolver | 0.0005 |
| Comparative 10 | 4 | Yes | Pressure Kneader | 0.008 |
| Comparative 11 | 4 | Yes | Henschel Mixer | 0.006 |
| Comparative 12 | 4 | Yes | Dissolver | 0.0007 |
| Comparative 13 | 4 | No | Pressure Kneader | 0.0005 |
| Comparative 14 | 4 | No | Henschel Mixer | 0.0002 |
| Comparative 15 | 4 | No | Dissolver | 0.00008 |

TABLE 4

| Sample No. | Sensitivity | Resolution | Abrasion Resistance |
|---|---|---|---|
| 19 | 5 | 4 | 4 |
| 20 | 5 | 4 | 4 |
| 21 | 4 | 4 | 3 |
| 22 | 4 | 4 | 4 |
| 23 | 4 | 4 | 3 |
| 24 | 5 | 4 | 4 |
| 25 | 5 | 4 | 4 |
| 26 | 4 | 4 | 3 |
| 27 | 4 | 4 | 4 |
| 28 | 4 | 4 | 3 |
| 29 | 5 | 4 | 4 |
| 30 | 4 | 4 | 4 |
| 31 | 4 | 4 | 3 |
| 32 | 4 | 4 | 4 |
| 33 | 4 | 4 | 3 |
| Comparative 7 | 3 | 3 | 2 |
| Comparative 8 | 3 | 3 | 2 |
| Comparative 9 | 3 | 3 | 2 |
| Comparative 10 | 2 | 2 | 1 |
| Comparative 11 | 2 | 2 | 1 |
| Comparative 12 | 1 | 1 | 1 |
| Comparative 13 | 2 | 2 | 1 |
| Comparative 14 | 2 | 2 | 1 |
| Comparative 15 | 1 | 1 | 1 |

According to the present invention, an image-forming material can be obtained which exhibits high sensitivity and resolution, and excellent resistance against abrasion.

What is claimed is:

1. An image-forming material comprising an image-forming layer and a support, said image-forming layer including 60% to 95% by weight of colorant particles, based on said image-forming layers, and a binder, there being a reduced adhesion force between said support and said image-forming layer at an exposed portion of said image-forming material, a Vickers hardness of whole layers on a side of said support having said image-forming layer is from 50 to 500, whereby said exposed portion of said image-forming layer can be removed from said support.

2. The image-forming material of claim 1 wherein Vickers hardness h of the image-forming layer is from 50 to 200.

3. The image-forming material of claim 1 wherein the image-forming layer is prepared by coating a liquid comprising colorant particles and a binder.

4. The image-forming material of claim 1 wherein the image-forming layer is hardened after coating and Vickers hardness $h_1$ before hardening is from 25 to 180 and Vickers hardness $h_2$ after hardening is from 50 to 200.

5. The image-forming material of claim 1 wherein total thickness of the whole layers on a side having an image forming layer is from 0.1 to 10.0 $\mu$m.

6. The image-forming material of claim 1 wherein colorant particles in the image-forming layer are those comprising a metallic atom.

7. The image-forming material of claim 6 wherein the metallic atom-containing particles are ferromagnetic metal powder.

8. The image-forming material of claim 1 wherein the image-forming layer has a thickness of 0.1 to 5.0 $\mu$m.

9. The image-forming material of claim 1 wherein the binder is at least one selected from polyurethane, polyester, vinyl chloride resin, phenoxy resin and cellulose series resin.

10. A preparation method of the image-forming material described in claim 1 wherein at least one selected from calendering and thermo-setting treatment is applied after coating and drying the image-forming layer.

11. The image-forming material of claim 1 wherein said image-forming material further comprises a protective layer.

12. An image forming material, wherein the image-forming material in which Vickers hardness h of an image-forming layer is from 50 to 200, may be prepared by a method that the image-forming layer is hardened after coating and Vickers hardness $h_1$ before coating is from 25 to 180 and Vickers hardness $h_2$ after coating is from 50 to 200 is prepared using at least one selected from calendering and thermosetting treatment after coating and drying the image-forming layer.

13. An image-forming method comprising imagewise exposing an image-forming material to form an exposed portion, said image-forming material comprising an image-forming layer which includes 60% to 95% by weight of colorant particles based on said image-forming layer and a binder on a support, whereby an adhesion force between said support and said exposed portion is reduced, removing said exposed portion of said image-forming layer from said support, a Vickers hardness H of whole layers on a side of said support having said image-forming layer is from 50 to 500.

14. The image-forming method of claim 13 wherein said Vickers hardness H is from 50 to 200.

15. The image-forming method of claim 13 further comprising coating a liquid including said colorant and said binder onto said support, thereby forming said image-forming layer.

16. The image-forming method of claim 15 wherein said image-forming layer is hardened after said coating and the Vickers hardness before hardening is from 25 to 180 and the Vickers hardness after hardening is from 50 to 200.

17. The image-forming method of claim 13 wherein a total thickness of the whole layers is from 0.1 to 10.0 $\mu$m.

18. The image-forming method of claim 13 wherein said colorant particles comprise a metallic atom.

19. The image-forming method of claim 18 wherein said particles are a ferromagnetic metal powder.

20. The image-forming method of claim 13 wherein said image-forming layer has a thickness of 0.1 to 5.0 $\mu$m.

21. The image-forming method of claim 13 wherein said binder is selected from polyurethane, polyester, vinyl chloride resin, phenoxy resin, cellulose resin, and mixtures thereof.

22. The image-forming method of claim 13 wherein a ratio of G'2/G'1 is adjusted to 0.01 or more, wherein G'1 is the storage elastic modulus at $10^{-4}$ of dynamic distortion and G'2 is the storage elastic modulus at $10^{-2}$ of the dynamic distortion of said whole layers.

23. The image-forming method of claim 22 wherein said ratio is from 0.03 to 1.0.

* * * * *